US006892789B2

(12) United States Patent
Boyle

(10) Patent No.: US 6,892,789 B2
(45) Date of Patent: May 17, 2005

(54) SOLID INVESTMENT MOLDING SYSTEM AND METHOD

(76) Inventor: Michael Boyle, P.O. Box 228, Danbury, NH (US) 03230

( * ) Notice: Subject to any disclaimer, the term of this patent is extended or adjusted under 35 U.S.C. 154(b) by 0 days.

(21) Appl. No.: 10/314,045

(22) Filed: Dec. 6, 2002

(65) Prior Publication Data

US 2004/0108090 A1 Jun. 10, 2004

(51) Int. Cl.[7] ..... B22C 9/04
(52) U.S. Cl. ..... 164/35; 164/246; 164/239
(58) Field of Search ..... 164/34, 35, 516, 164/165, 235, 245, 361, 239, 246

(56) References Cited

U.S. PATENT DOCUMENTS

| | | | | |
|---|---|---|---|---|
| 2,193,357 A | | 3/1940 | Greth | |
| 2,219,640 A | | 10/1940 | Summy | |
| 3,587,722 A | | 6/1971 | Slansky | |
| 4,040,466 A | * | 8/1977 | Horton et al. | 164/17 |
| 4,291,739 A | * | 9/1981 | Baur | 164/5 |
| 4,576,216 A | | 3/1986 | Perna | |
| 4,777,996 A | | 10/1988 | Finelt | |
| 5,257,658 A | | 11/1993 | Perera | |
| 5,318,093 A | | 6/1994 | MacDonald | |
| 5,406,999 A | | 4/1995 | Berger et al. | |
| 5,896,913 A | | 4/1999 | Grandi | |
| 6,349,759 B1 | | 2/2002 | Wheaton | |
| 6,568,458 B2 | * | 5/2003 | Naik et al. | 164/361 |
| 6,588,484 B1 | * | 7/2003 | Fosaaen et al. | 164/28 |

OTHER PUBLICATIONS

The Original Wax Web, Rio Grande News & Product Review, Winter 2002, vol. 3, No. 1, p. 5.
A Solid Investment Mold Diagram, Sculpture Journal, Jun. 2002, vol. 6, No. 4, p. 24.
Conley Casting Supply Catalog, Conley Casting Supply Corp., p. 9.

* cited by examiner

*Primary Examiner*—Kiley S. Stoner
*Assistant Examiner*—Len Tran
(74) *Attorney, Agent, or Firm*—Robert R Deleault, Esq.; Mesner & Deleault PLLC

(57) ABSTRACT

A lost wax molding system has a re-usable, collapsible, chain-linked mesh exoskeleton, one or more inserts to be placed within the interior surface of the mesh exoskeleton to exert outward pressure on the mesh exoskeleton thereby creating a pre-formed, rigid, three-dimensional shape, a waterproof sleeve sized to cover the outer surface of the three-dimensional shape, and a base sized to seal said waterproof sleeve forming an investment mold container.

12 Claims, 4 Drawing Sheets

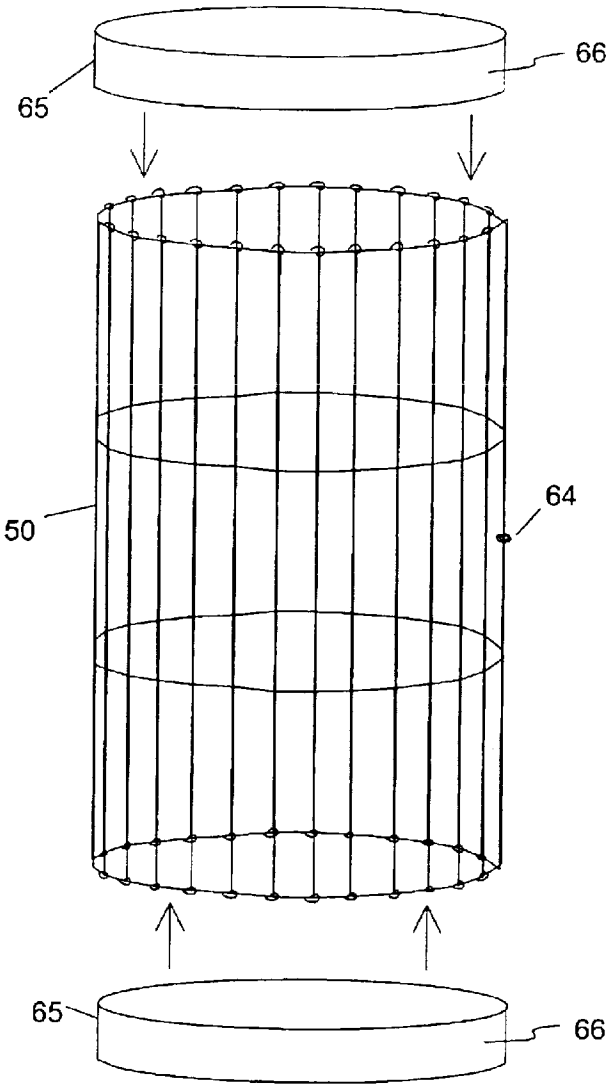
Fig. 2
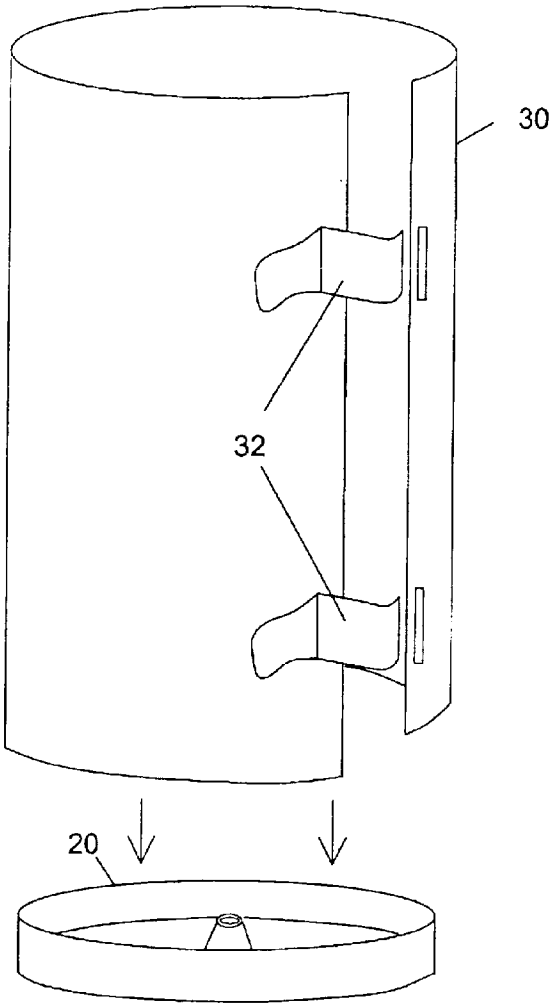

SOLID INVESTMENT MOLDING SYSTEM AND METHOD

BACKGROUND OF THE INVENTION

1. Field of the Invention

The present invention relates generally to solid investment molding by the lost wax process. Particularly, the present invention relates specifically to structures used in the formation of solid investment molds and methods of use of those structures.

2. Description of the Prior Art

The lost wax casting process involves the formation of a pattern of the desired object to be cast. The pattern is customarily formed of wax or plastic having the desired burnout characteristics. The wax pattern or wax positive, to which sprues of the same material as the pattern have been attached, is then embedded in a mixture of refractory investment materials such as Plaster of Paris. The resulting invested pattern is then subjected to intense heat in order to drive out moisture from the investment material and to completely eliminate the wax or plastic used for the pattern and sprue. The burnout procedure results in the formation of a mold cavity in the investment mass. Molten metal is then introduced into the mold cavity by gravity feed, vacuum-assisted gravity feed or centrifugal casting methods and the resultant cast is recovered by destruction of the investment mass.

A structure is required in the solid investment molding process to contain the initial refractory investment materials that are poured around the wax pattern to form a reverse mold of that pattern. Prior art structures used to initially form solid investment molds for use in the lost wax process include a solid-walled metal flask, a metal perforated flask with a casting chamber, a solid-walled metal flask with a wax flask liner, and a solid-walled metal flask with an artisan-made chicken wire form.

The solid-walled metal flask gives rigidity to an investment mold during the metal casting process. The non-porous structure of the solid-walled metal flask does not allow moisture and impurities to be easily burned off during the heating process. It also makes it difficult to remove the investment mold from the solid-walled metal flask when the entire process is complete.

The perforated stainless steel flask for use with a casting chamber was developed to more easily allow moisture and impurities to be burned off during the heating process. U.S. Pat. No. 5,257,658 (1993, Perera), discloses a perforated stainless steel casting flask as it is used in vacuum casting within a casting chamber. During the initial investment material pouring process, the perforated flask requires an external sheath to keep the investment from leaking out until the molding investment material sets up. The perforated stainless steel casting flask allows gas to be evacuated through the holes within the flask during the final casting where the heated metal liquid such as bronze is poured into the flask. The perforated flask, like the solid walled flask, also requires pressure or force to be applied to remove the investment mold from the flask.

The wax flask liner was developed as an alternative to the perforated metal flask. The wax flask liner is a wax mesh sheet, sold under the trademark of "Wax Web," that is placed up against the inside surface of the solid-walled, cylindrical flask during the assembly of the investment molding structure. A wax sprue and a wax pattern are placed inside the metal flask cavity. The liquid investment material, which is generally Plaster of Paris, is then poured into the metal flask surrounding the wax sprue and the wax pattern. Once the investment material has set up at room temperature, the solid-walled metal flask containing the wax pattern, the investment material, and the wax mesh sheet is heated in a kiln. The heating process removes water and other impurities from the investment material, cures the investment material, and burns out the wax pattern and the wax mesh sheet. The porous cavities left after the wax mesh sheet is burned away allows moisture and other impurities to escape more easily from the curing investment material during this kiln-heating process, which is also called the burnout process.

After the investment material has cured and the wax burned out, a molten metal such as bronze is poured into the mold cavity and allowed to cool to solidify the molten metal. Because the metal flask is a single piece, cylindrical tube, the investment mold is difficult to remove. To remove the investment mold from the metal flask, pressure or force must be applied to the investment mold to separate it from the metal flask.

For relatively large investment molds, chicken wire has been used by artisans in an investment molding system to create initial investment mold structures of varying size and shape. A diagram of solid investment mold making that shows an example of a chicken wire structure is disclosed in *Sculpture Journal*, Vol. 6, No. 4 (June 2002), p. 24. Chicken wire is flexible and can be bent to form an unusually sized investment molding structure. Chicken wire forms, due to a relatively large ratio of opening size to solid wire surface area that is larger than the wax liner or the perforated flask, have allowed for better moisture removal, cleaner more complete burnout, and good gas flow during the introduction of the molten metal than the other prior art structures hereinbefore disclosed. With the added reinforcement provided by the chicken wire after the plaster as set up, there is generally no longer a need for an external containment vessel to remain with the mold through the burn out and metal pouring steps.

However, such a mold is prone to cracking and may need to be handled carefully and given additional reinforcement, often by packing sand around the mold before pouring the molten metal. Other drawbacks of the chicken wire system are that it has only tensile strength and little, if any, compression strength. It also does not lend itself to vacuum assist pouring. It is very time consuming to cut and form the chicken wire to the desire shape and protective gloves and care must be used to avoid injury from the chicken wire.

In addition, chicken wire is usually galvanized with a metal that prevents oxidation. While galvanic coating is useful to prevent corrosion of the chicken wire when exposed to the elements, it is detrimental when used as an investment molding structure. The galvanization creates undesired gases at high temperatures that can potentially cause contamination of the investment mold. Further, the burn out process causes the chicken wire structure to lose its galvanized surface, thereby allowing the chicken wire form to oxidize. Oxidation and other physical changes in chicken wire during the burn out process render the chicken wire form entirely altered and not recommended for re-use. Although chicken wire forms can be easily pulled away from the investment mold, the chicken wire form becomes disfigured from this extraction process and cannot be easily re-formed for re-use. Thus, chicken wire forms must be newly created each time a new investment mold is made.

Therefore, what is needed is an investment molding structure that is reusable. What is also needed is an investment molding structure that allows for quick moisture removal, clean and complete wax burn out, and good gas flow. What is further needed is an investment molding structure that has both tensile strength and compression strength for use in both hand pouring and vacuum assisted pouring. What is still further needed is an investment molding structure that is flexible and may be easily formed into varying shapes and sizes. What is yet further needed is an investment molding structure that does not require the use of protective gloves to prevent injury during investment structure assembly. What is also needed is an investment molding structure that is collapsible for easy storage. What is even further needed is an investment molding structure that can be more easily removed from the waterproof sleeve without the need for additional pressure or force. What is needed is an investment molding structure that does not need additional external reinforcement for receiving the molten metal after removal from the containment structure.

SUMMARY OF THE INVENTION

It is an object of the present invention to provide an investment molding system having a structure that is reusable. It is another object of the present invention to provide an investment molding system having a structure that allows for quick moisture removal, clean and complete wax burn out, and good gas flow. It is a further object of the present invention to provide an investment molding system having a structure that has both tensile strength and compression strength for use in both hand pouring and vacuum assisted pouring. It is still another object of the present invention to provide an investment molding system having a structure that is flexible and may be easily formed into varying shapes and sizes. It is yet another object of the present invention to provide an investment molding system having a structure that does not require the use of protective gloves to prevent injury during investment structure assembly. It is another object of the present invention to provide an investment molding system having a structure that is collapsible for easy storage. It is a further object of the present invention to provide an investment molding system having a structure that allows for easier removal from the sleeve/flask container of an investment mold without the need for additional pressure or force. It is another object of the present invention to provide an investment molding system having a structure that does not need additional external reinforcement for receiving the molten metal after removal from the containment structure.

The present invention achieves these and other objectives by providing a solid investment lost wax molding system having a base, a supporting exoskeleton, and a containment sheath/sleeve. The base is typically circular in shape and made of a resilient-type of material such as rubber and the like. The pour cup with the wax sprue and the wax model pieces, i.e. the wax positives, is secured typically to the center of the base. The base is used to seal the end of the containment sheath or flask to prevent leakage of the liquid investment material, i.e. plaster of Paris.

The supporting exoskeleton includes one or more inserts removably positioned inside of the supporting exoskeleton. The exoskeleton is made of an interwoven, chain-linked mesh. The insert imparts an outward pressure on the inside surface of the exoskeleton forming a pre-stressed, self-supporting structure thereby creating an inner containment area for the investment material. The exoskeleton is made of a material that has both tensile strength and compression strength, which allows the exoskeleton to withstand the stresses of the molding process a plurality of times. In other words, the exoskeleton is reusable.

Stainless steel is the material of choice for construction of the exoskeleton. The use of the exoskeleton is relatively cheap and readily available compared to custom manufactured and welded stainless steel sheet metal. Because the exoskeleton is an interwoven, chain-linked mesh incorporating a plurality of relatively rigid wire-like or rod-like structures, it can be cut and formed to size and shaped by using internal bands or inserts of various size and shape to accommodate any size and shape mold with a predetermined volume. The same mesh exoskeleton can be used to accommodate various shapes such as round, oval, square, rectangular, etc. The chain-linked mesh structure makes it collapsible for storage, adjustable for various sizes and reusable, a marked advantage for investment mold production. The mesh structure provides little, if any, risk of injury in handling. Because the mesh structure has good tensile and compression strength, removal of the exoskeleton from the investment mold after casting is much easier than any of the prior art structures.

The containment sheath surrounds the exoskeleton and creates a seal with the base to hold the liquid investment material until it solidifies. Because the exoskeleton is self-supporting and structurally strong enough to withstand the rigors of the burnout and casting process, the containment sheath is removed along with the base from the exoskeleton and solidified investment material before the burnout process is begun. Thus, the containment sheath may be made of any material that is waterproof. Examples of acceptable materials are metal flashing, linoleum, plastic wrap, pliable polymer sheeting, etc.

In use, the investment molding system of the present invention has proven to minimize any mold cracking equal to that experienced even with a solid, conventional metal flask. Even when cracking does occur, there is no need for any external reinforcement such as packing in sand when pouring the molten metal as is sometimes needed with the chicken wire structure. Like the chicken wire structure, the present invention provides for quicker moisture removal since the containment sheath or sleeve is removed before the burnout process. Because there is no metal flask around the investment mold, wax burnout is cleaner and more complete.

BRIEF DESCRIPTION OF THE DRAWINGS

FIG. 2 is a perspective view of the present invention showing the individual components of the solid wax investment molding system.

DETAILED DESCRIPTION OF THE PREFERRED EMBODIMENT

Figure 1:
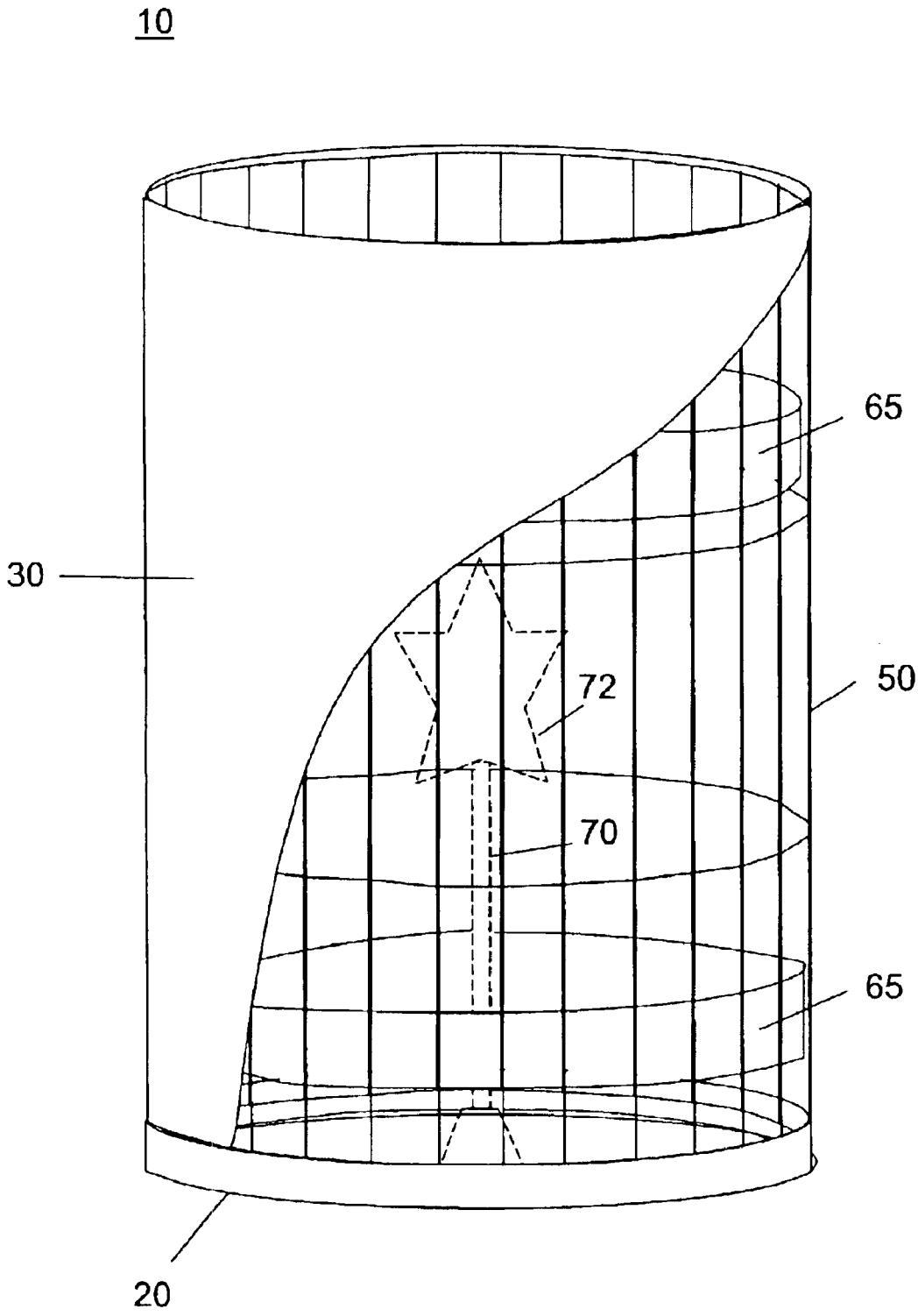
FIG. 1 is a perspective view of the present invention showing the solid wax investment molding system components assembled for casting.

The preferred embodiment of the present invention is illustrated in FIGS. 1–4. FIG. 1 shows one embodiment of the solid wax investment molding system 10 that includes a base 20, a waterproof sleeve 30, an exoskeleton 50, and at least one exoskeleton insert 65. A wax sprue 70 and a wax form or pattern 72 are shown being held in position within base 20. At least one exoskeleton insert 65 is placed within exoskeleton 50 causing exoskeleton 50 to retain a tubular shape. Exoskeleton insert 65 exerts outward pressure on the inside surface of exoskeleton 50 so that the cylindrical shape is rigid and stable.

Base 20 is typically made of a polymer-based material such as rubber or plastic or other suitable material. Preferably, the base material is soft and pliable so that base 20 is capable of adapting to and supporting either sleeve 30 or exoskeleton 50, either of which might be distorted from use, and to form a seal with sleeve 30. Typically, base 20 has a tapered sprue and a flat back having a large center hole for button sprueing, i.e. where the wax sprue can be adequately secured thereto so that investment material will not cause the wax sprue to move. Typically, base 20 is available in various diameters, 3.5, 4, 5, and 6 inches being the most common.

Waterproof sleeve 30 is typically a cylindrical tube made of 12-gauge stainless steel and is known in the art as a casting flask. Sleeve 30 is generally available in varying diameters from about 3.5 inches to about 6 inches and in lengths from about 3.5 inches to about 10 inches. Sleeve 30 may also be made from stainless steel sheet that is cut, formed and welded into a cylindrical shape.

Exoskeleton 50 in combination with at least one exoskeleton insert 65 are the critical components of the present invention. Exoskeleton 50 is a wire-mesh form having a chain-link structure and made of a material having sufficient tensile strength and compression strength to withstand the stresses of the mold-forming process as well as the casting process. Stainless steel is the preferred material as it is resistant to corrosion from the moisture in the plaster and is capable of withstanding the elevated temperatures of the burnout and casting processes without breaking down or weakening. One of the main advantages of using exoskeleton 50 is that sleeve 30 may be removed along with base 20 after the plaster has set. Exoskeleton 50 provides sufficient support to the mold while the mold undergoes the burnout process.

The ability of the exoskeleton 50 to provide sufficient support to the set mold after the plaster has set allows sleeve 30 to be made of any waterproof material that can be used to surround exoskeleton 50. Examples of acceptable material are metal flashing, linoleum, plastic wrap (e.g. Saran®), pliable polymer sheeting, etc.

Turning now to FIG. 2, there is illustrated another embodiment of the lost-wax molding system of the present invention. This embodiment includes a base 20, a sleeve 30, an exoskeleton 50, and a pair of exoskeleton inserts 50. Sleeve 30 is a curved sheet of a waterproof material with a pair of clamp-type fasteners 32. Fasteners 32 secure one end of sleeve 30 to the other end forming a cylindrical tube. Exoskeleton 50 is a sheet of wire mesh also formed into a cylindrical tube and secured by a closure 64. Closure 64 may be any type of fastener that will hold the joined ends of exoskeleton 50 together. Closure 64 may be releasably attached to the ends of exoskeleton 50 or may be permanently affixed.

Exoskeleton insert 65 has a size, shape and rigidity sufficient to impart a predefined shape to exoskeleton 50. Preferably, exoskeleton insert 65 is a circular band made of stainless steel. Exoskeleton insert 65 is preferably a circular band having a flat surface 66 approximately 1 inch wide that contacts the inside surface of exoskeleton 65. Insert 65 has a thickness of approximately 0.80 inches. The typical diameter of insert 65 is approximately 4.75–5 inches. Insert 65 can be any shape sized to conform to the shape of the desired wax pattern. For example, these shapes may be an oval, an oblong, a rectangle, a square, etc. Shaped insert 65 creates the three-dimensional, rigid structure of exoskeleton 50 with a volume sized to contain the wax pattern and enough surrounding space so that a sufficient amount liquid investment material can be poured and set around the wax pattern.

Figure 3:
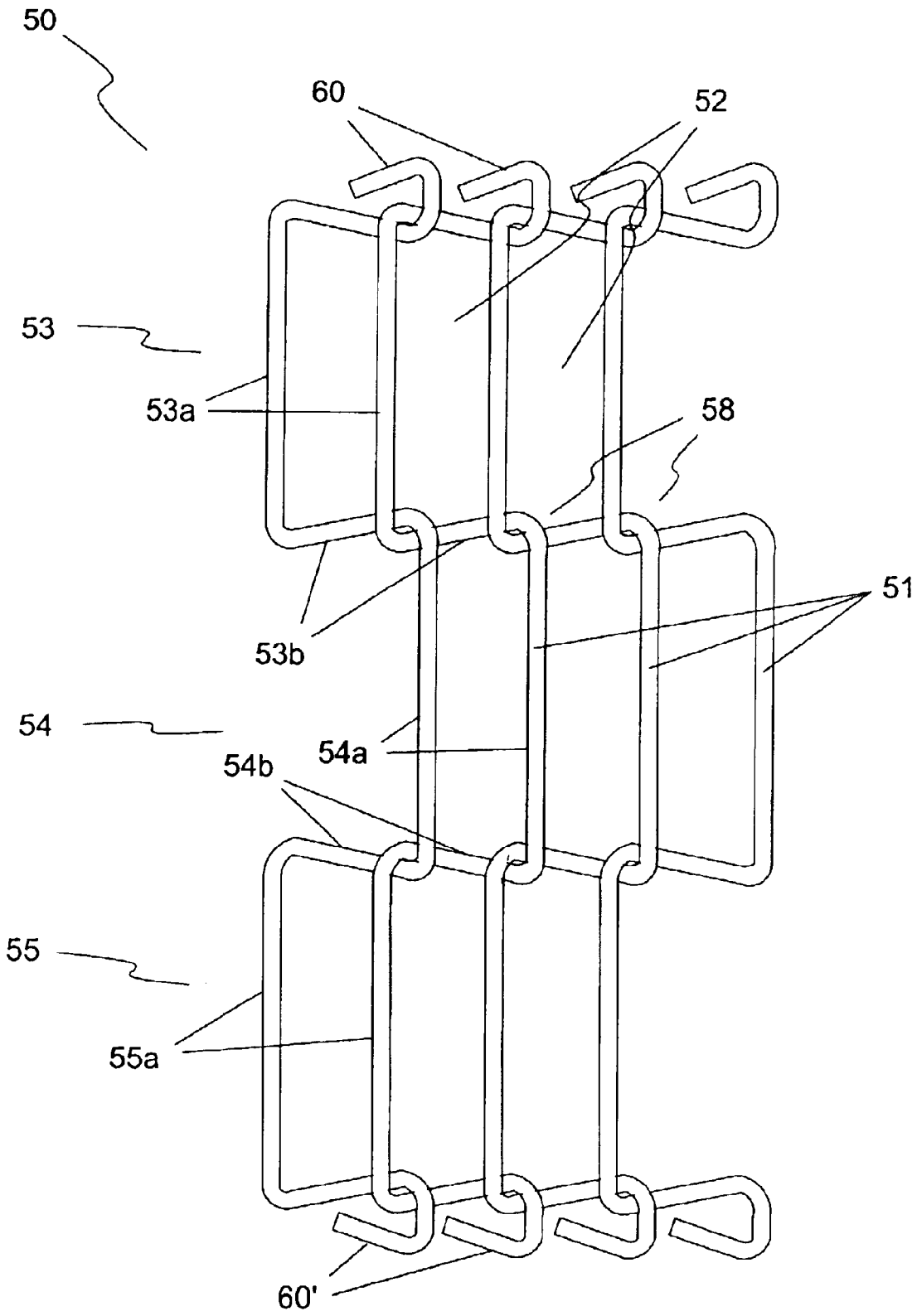
FIG. 3 is an enlarged side view of one embodiment of the exoskeleton of the present invention showing the interwoven, chain-link configuration.

Turning now to FIG. 3, there is shown an enlarged view of the preferred embodiment of exoskeleton 50. Exoskeleton 50 is made of a collapsible, interwoven mesh much like that of a chain-linked fence where each metal wire of the chain-linked fence is interwoven with adjacent, similarly shaped wire. Exoskeleton 50 includes a plurality of shaped wires 51 that are interwoven to form rectangularly shaped structures 52 having a length of approximately 2.6 inches and a width of approximately 0.6 inches. Wires 51 have an overall diameter of about 0.08 inches.

To form such a structure, wires 51 are each bent forming three sections 53, 54 and 55 that begin and end in chain loops 60 and 60'. The uppermost end of single wire 51 (approximately 1 inch) is bent transverse to the wire at approximately one hundred degree angle from the vertical to form chain loop 60 by folding wire 51 across an adjacent wire at about 0.6 inches and then folding the remaining end forming a loop 60 around the adjacent wire. From the uppermost chain loop 60, wire 51 has an elongated section 53*a* of approximately 2.6 inches in length extending downward. A section 53*b* of approximate length of 0.6 inches is then bent transverse to section 53*a* and in the same direction as chain loop 60. Wire 51 is again folded transverse to section 53*b* over the adjacent wire. A second longitudinal section 54*a* of approximately 2.6 inches in length extends downward to a second horizontal section 54*b*. Section 54*b* is about 0.6 inches in length and is transverse to section 54*a* back toward the longitudinal axis A–A' of section 53*a*. Section 54*b* is folds over the adjacent rightmost wire. A third longitudinal section 55*a* of approximately 2.6 inches in length extends downward along the longitudinal axis A–A' culminating at the lowermost end of wire 51 in lowermost chain loop 60'. Chain loop 60' is formed with the adjacent rightmost wire similar in shape to that of uppermost chain loop 60.

The pattern of three longitudinal sections interspersed at even intervals with two horizontal sections bent at transverse angles and folded over the succeeding rightmost identical wire 51 continues until a pre-determined number of folded chain linkages 58 has occurred to form exoskeleton 50 having the desired overall dimensions. In this preferred embodiment, three longitudinal sections and two horizontal sections are described, however, wires 51 of any length could be used to increase or decrease the numbers of longitudinal and horizontal sections so that an exoskeleton 50 of the desired pre-determined dimension is reached. It should be noted that the interconnected sections may form any desired shape so long as each of the plurality of wires 51 are chain-linked and not fixedly secured to each other.

To use the embodiment of the exoskeleton 50 of the present invention shown in FIG. 3, a wax sprue 70 with one or more wax positives 72 is secured to base 20. Sleeve 30 is assembled and connected to base 20 forming a watertight container. Exoskeleton inserts 65 are inserted into exoskeleton 50 to provide a stressed, rigid, three-dimensional structure sized to slidably fit inside sleeve 30. Exoskeleton 50 is then inserted into sleeve 30. Liquid investment material, i.e. plaster, is poured into the container and allowed to set up under room conditions. This typically takes about one hour. Base 20 and sleeve 30 are removed after set up has occurred.

Figure 4:
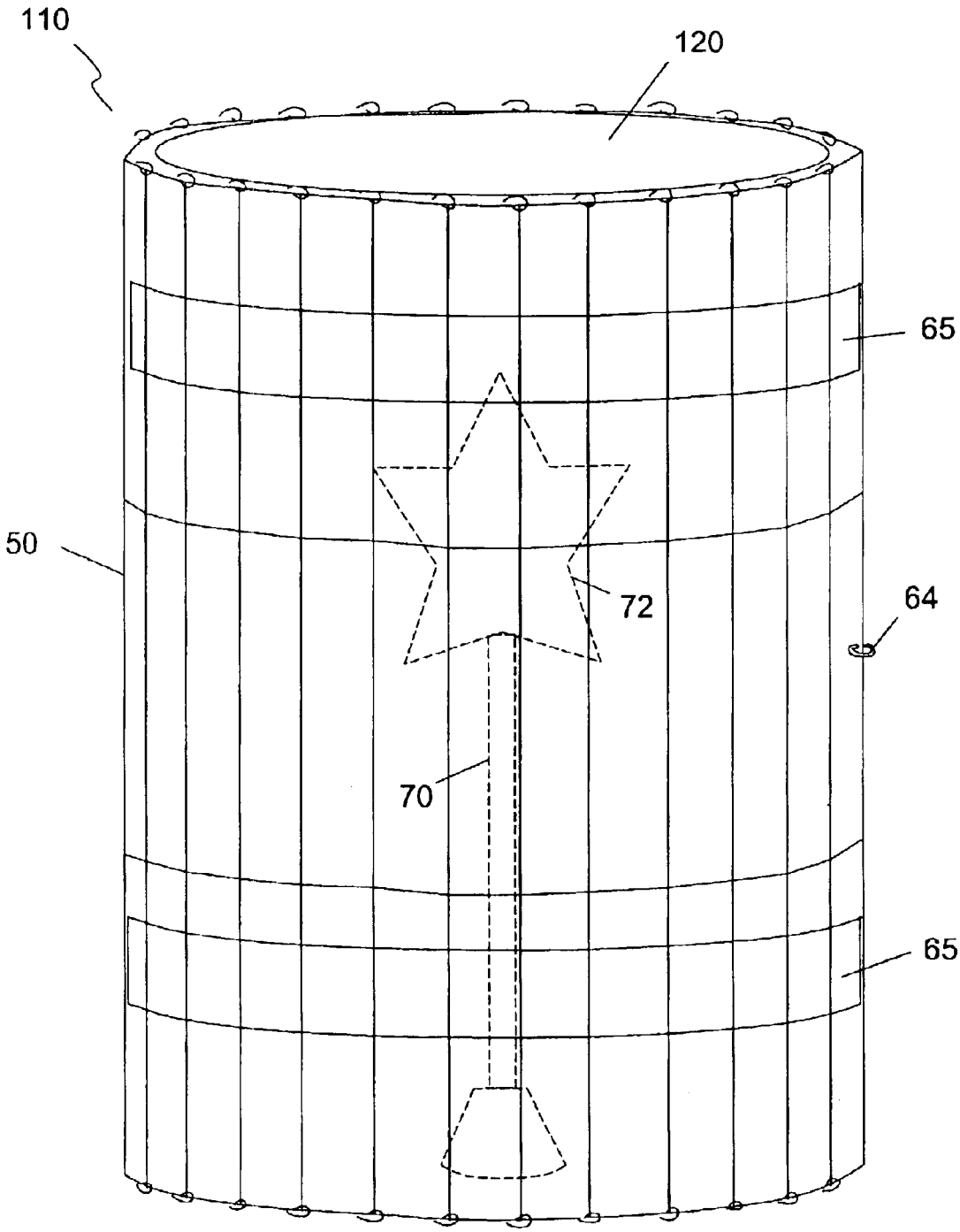
FIG. 4 is a prospective view of an investment mold after removal of the waterproof sleeve or sheathing and the base.

Cylindrical mold 110, which is composed of exoskeleton 50 and inserts 65, remains affixed to the room temperature hardened plug 120 that is composed of investment material and the wax sprue and wax positive, as shown in FIG. 4. Cylindrical mold 110 is then placed within an oven. A multi-stepped time and temperature burnout process is performed to remove water and other impurities from the investment materials and to disintegrate and burn off the wax sprue and wax positive leaving a casting mold. The following is an example of a multi-stepped time and temperature burn out process that may be used is to heat the cylindrical mold 110:

300 degrees Fahrenheit for two hours;

600 degrees Fahrenheit for two hours;

900 degrees Fahrenheit for two hours;

1350 degrees Fahrenheit for four hours.

The times of the burnout process may be changed depending on the size of the mold. Once the burnout process is complete, cylindrical mold 110 is then cooled to a temperature that is slightly below the melting temperature of the molten casting metal that will be used to make a cast from mold 110. Cylindrical mold 110 now contains a void where the wax sprue and wax positive previously occupied. Molten metal is poured into this void to create the final cast product. Unlike the prior art, the present invention undergoes the burnout and casting process without sleeve 30. This allows more even heat distribution through mold 110 and a more even gas diffusion out of mold 110 caused by the elevated temperatures of the burnout and casting process.

It should be understood that the removal of the wax sprue and wax positive can be accomplished by other methods such as autoclaving or other steam-type systems. When plastic is used as the positive, chemical methods may also be used.

Once the molten metal has cooled, exoskeleton 50 is removed from mold 110. Because exoskeleton 50 with inserts 65 are at the outer surface of mold 110, they are easily removed by lightly hitting the exoskeleton 50 and inserts 65 with a tool to breakaway the thin layer of plaster that holds exoskeleton 50 and inserts 65 to mold 110. After removal, the remaining mold 110 is then broken to reveal the metal end product within. Exoskeleton 50 and inserts 65 may now be re-used to form additional investment molds or stored for later use. If stored, inserts 65 may be removed from the interior of exoskeleton 50 so that exoskeleton 50 can be collapsed into a flattened, easily stored, structure.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A lost-wax molding system comprising:

a base having a bottom, a circumferential wall and a central structure configured to receive a sprue and a wax mold;

a sleeve removably connected to said base forming a watertight container; and a reusable exoskeleton slidably engaged within said waterproof sleeve, said reusable exoskeleton having at least one shape-forming insert within said reusable exoskeleton and wherein said reusable exoskeleton is a chain-linked mesh.

2. The system of claim 1 wherein said base is made of a flexible and pliable material.

3. The system of claim 1 wherein said sleeve is waterproof.

4. The system of claim 1 wherein said reusable exoskeleton is made of a material having a tensile strength and a compression strength sufficient to withstand the burnout process of a lost-wax investment molding process.

5. The system of claim 4 wherein said material is made of metal.

6. The system of claim 5 wherein said metal is stainless steel.

7. A lost-wax molding kit comprising:

a base having a central structure for receiving and holding a sprue;

a reusable chain-linked mesh structure;

at least one insert configured for insertion into said reusable chain-linked mesh structure and capable of placing said reusable chain-linked mesh structure into a structurally stressed condition forming a rigid three-dimensional, chain-linked enclosure for mating with said base; and a waterproof material capable of surrounding said chain-linked enclosure and forming a waterproof seal with said base.

8. The kit of claim 7 wherein said reusable chain-linked mesh structure is made of a material having a tensile strength and a compression strength capable of withstanding the burnout procedure of a lost-wax molding process.

9. The kit of claim 8 wherein said material is metal.

10. The kit of claim 9 wherein said metal is stainless steel.

11. The kit of claim 7 wherein said waterproof material is a pliable sheet made of a metal, a nonmetal, a composite, or a polymer.

12. The kit of claim 7 wherein said waterproof material is one of sheet metal, linoleum, rubber, polyvinyl chloride, or plastic wrap.

* * * * *